US008950015B2

(12) United States Patent
Gibby

(10) Patent No.: US 8,950,015 B2
(45) Date of Patent: Feb. 10, 2015

(54) GLOVE WITH LAMINATED PADDING REGIONS

(75) Inventor: Garth Roy Gibby, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 469 days.

(21) Appl. No.: 12/976,248

(22) Filed: Dec. 22, 2010

(65) Prior Publication Data

US 2012/0159681 A1 Jun. 28, 2012

(51) Int. Cl.

| | |
|---|---|
| ***A41D 19/00*** | (2006.01) |
| ***A63B 71/14*** | (2006.01) |
| ***A41D 13/015*** | (2006.01) |
| ***A41D 13/05*** | (2006.01) |
| ***A41D 19/015*** | (2006.01) |
| ***A41D 31/00*** | (2006.01) |
| ***A41F 1/06*** | (2006.01) |

(52) U.S. Cl.

CPC ..... *A63B 71/148* (2013.01); *A41D 13/0156* (2013.01); *A41D 13/0581* (2013.01); *A41D 19/001* (2013.01); *A41D 19/01523* (2013.01); *A41D 31/005* (2013.01); *A41F 1/06* (2013.01); *A63B 2243/007* (2013.01)

USPC ..... 2/161.1; 2/163

(58) Field of Classification Search

USPC ..... 2/16, 20, 161.1, 161.6, 163

See application file for complete search history.

(56) References Cited

U.S. PATENT DOCUMENTS

| | | | | |
|---|---|---|---|---|
| 4,094,014 | A * | 6/1978 | Schroeder | 2/161.8 |
| 4,864,660 | A * | 9/1989 | Sawyer | 2/20 |
| 5,987,646 | A * | 11/1999 | Bolmer | 2/161.1 |
| 6,618,860 | B1 * | 9/2003 | Sullivan et al. | 2/159 |
| 2003/0000005 | A1 * | 1/2003 | Faulconer | 2/161.1 |
| 2005/0114985 | A1 * | 6/2005 | Falone et al. | 2/161.1 |
| 2007/0113317 | A1 * | 5/2007 | Garneau | 2/161.1 |
| 2008/0172779 | A1 * | 7/2008 | Ferguson | 2/455 |

FOREIGN PATENT DOCUMENTS

| | | | |
|---|---|---|---|
| GB | 2233877 | * | 1/1991 |

* cited by examiner

*Primary Examiner* — Katherine Moran

(74) *Attorney, Agent, or Firm* — Shook, Hardy & Bacon L.L.P.

(57) ABSTRACT

A glove may comprise at least one laminated padded portions affixed to at least one other portion. A laminated padded portion may comprise an inner layer, an outer layer, and at least one pad. The at least one pad may be secured by laminating the outer layer to the inner layer with the at least one pad retained between the inner layer and the outer layer without stitching. The at least one pad may be positioned to protectively cover portions of the wearer's hand.

16 Claims, 3 Drawing Sheets

GLOVE WITH LAMINATED PADDING REGIONS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to gloves worn to protect the hands of an individual. More particularly, the present invention relates to gloves worn by American football players to protect their hands during play or practice.

BACKGROUND OF THE INVENTION

Gloves are worn in a variety of sports for purposes such as protection of the hands and to enhance the grip or feel of an athlete. American football players encounter particular needs to protect their hands. The need to protect a player's hands from injury is particularly acute for some positions. For example, offensive line play can place significant demands, such as impacts with other players, upon the hands of the linemen. Similarly, defensive players, especially along the defensive line, can risk harm or injury to their hands during the normal course of play. For this reason, protective gloves are often worn by football players, particularly offensive linemen and defensive players. Such protective gloves often include padding to soften blows to portions of the player's hand. Cushioning may be particularly desirable along portions of a hand with less from the soft tissue of the hand, such as the knuckles or fingers, or areas for which contact frequently occurs, such as the heal of the hand. Padding may be added to a protective glove by stitching a layer of pliable material, such as fabric, leather, etc., over a pad of material to retain the pad in place while the glove is worn. Unfortunately, the stitching to retain padding itself may be particularly apt to fray, tear, break, or otherwise degrade, particularly since padding may often be placed so as to protect areas of frequent contact on a player's hand. Further, stitching necessarily penetrates the fabric of the glove, which weakens the fabric itself and renders it susceptible to ripping and/or tearing. If a glove will be exposed to moisture, such as perspiration or precipitation, which can further weaken stitching and lead to material cracking as the moisture dries.

BRIEF SUMMARY OF THE INVENTION

The present invention provides a glove for protecting the hands of an athlete, such as offensive linemen, defensive football players, and other athletes from damage due to striking other players or equipment while avoiding problems associated with failure of stitching used in attaching padding to a glove.

In accordance with the present invention, padding may be situated between an outer glove layer and an inner glove layer, with the outer layer than being laminated to secure it to the inner glove layer with the padding thereby secured between the inner layer and the outer layer. A glove in accordance with the present invention may comprise one or more portions constructed by laminating pads between an outer layer and an inner layer, with the one or more laminated portion being joined, for example by conventional stitching, to other laminated and/or non-laminated portions to form a whole glove to cover a wearer's hand. Laminated padding portions may be segmented to enhance flexibility, particularly a long finger and/or thumb portions where articulation may be desired.

A glove in accordance with the present invention may comprise one or more laminated padded portions. A laminated padded portion may comprise an inner layer, an outer layer, an adhesive layer bonding the outer layer to the inner layer, and at least one pad secured between the inner layer and the outer layer. The bond between the inner layer and the adhesive layer and between the outer layer and the adhesive layer may be formed through heat and pressure, but may also be formed through radio frequency or ultrasonic bonding processes. The amount of heat and pressure applied to form the bonds may depend upon the specific material utilized for the adhesive layer, which may be a thermoplastic polymer, such as polyurethane, polyamide, polyester, polyolefin or vinyl. In general, heat and pressure induces the adhesive layer to infiltrate the structure of the inner layer and/or the outer layer. Upon subsequent cooling, the adhesive layer becomes securely bonded to the inner layer and/or the outer layer.

A glove in accordance with the present invention may comprise at least a first padded portion and at least a second portion. The at least a first padded portion may be affixed to at least a second portion to form a cavity such that the glove may be detachably retained on the hand of a wearer inserted into the cavity. A laminated portion may comprise an inner layer that contacts the hand of a wearer when the glove is worn, an outer layer that comprises the outer layer of the glove when the glove is worn, and at least one pad, or optionally a plurality of pads, secured between the outer layer and the inner layer without stitching. The at least one pad may be positioned so that when the glove is worn the pads protect portions of the hand of the wearer without covering a finger or thumb joint of the wearer. Pads of the at least one laminated portion may be positioned to protect the heel of the hand, knuckles, portions of a finger, portions of a thumb, etc. Laminated portions may comprise palm portions, back portions, thumb portions, etc. The at least a second portion may comprise non-laminated portions. Non-laminated portions may be constructed of an elastic material(s).

The present invention also provides methods for forming protective gloves. Methods in accordance with the present invention may comprise preparing at least one laminated portion by forming pads, cutting an inner layer, and cutting an out layer. The pads may be adhered to desired locations on the inner layer, and then the outer layer may be laminated to the inner layer. Adhering pads to desired locations on the inner layer may comprise positioning the pad to protect the heel of the hand, knuckles, portions of fingers, portions of thumbs, etc., and then securing the pads in place with tape, adhesives, etc. The pads may be positioned such that when the formed glove is worn the pads do not cover a joint of a thumb and/or finger. At least a second portion may be formed, and the at least one laminated portion may be affixed to the at least one additional portion to form a cavity such that the glove may be detachably retained on the hand of a wearer.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, steps, or combinations of components or steps similar to the ones described in this document, in conjunction with other present or future technologies.

Gloves in accordance with the present invention provide padding to protect the hand of a wearer by laminating padding between an outer layer and an inner layer. The inner layer may be oriented between the padding and the hand of a wearer when the glove is worn, and the outer layer may be oriented external to the padding when the glove is worn. In accordance with the present invention, a glove may comprise one or more portions or regions for which padding is retained by laminating an outer layer to an inner layer. The padding may be segmented to permit enhanced flexibility and articulation. Other glove portions, which may or may not provide padding for a wearer, may be joined to the laminated portion to form an entire glove to be worn by a user. Portions of a glove may be joined together by stitching, gluing or other adhesives, lamination, or any other method.

Figure 1:
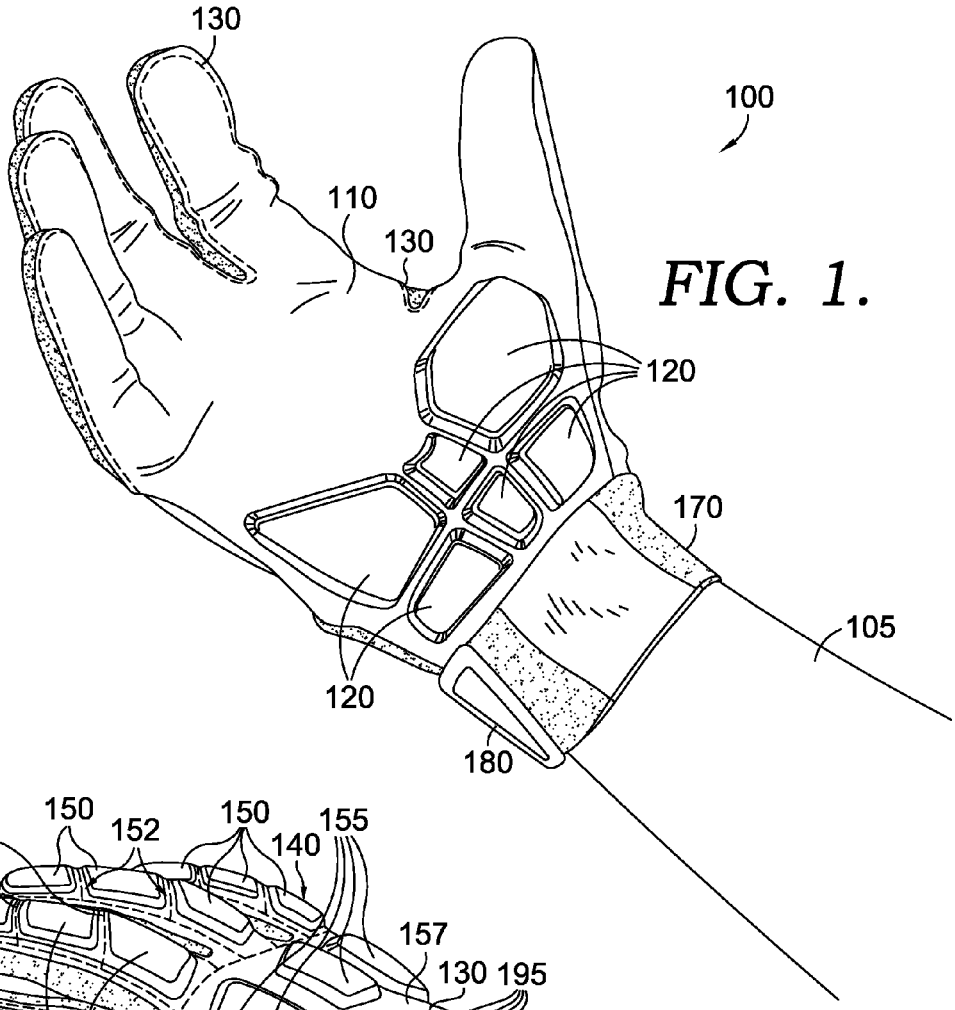
FIG. 1 illustrates a palm view of a glove in accordance with the present invention.

Referring now to FIG. 1, a glove 100 in accordance with the present invention is illustrated. Glove 100 may comprise a palm portion 110 that is a first laminated padded portion. Palm portion 110 may comprise an outer layer of, for example, a rubber or TPU material laminated to an inner layer to secure between the outer layer and the inner layer a plurality of pads 120. Of course, laminated padded portion 110 of glove 100 may also comprise a plurality of finger extensions and thumb extensions, although a glove in accordance with the present invention may also be partially or entirely fingerless, or a glove in accordance with the present invention may incorporate separate finger and/or thumb portions that are not integral with a laminated padded palm portion. Palm portion 110 may be joined to other components of glove 100 by a variety of attachment methodologies, such as seam 130. Other attachment methodologies may also be used, such as adhesives, lamination, etc. By affixing the various portions of a glove in accordance with the invention a cavity may be formed that permits the glove to be detachably retained on the hand of a wearer. Glove 100 may include a wrist cuff 170. Wrist cuff 170 may provide an attachment tab 180 that utilizes hook and loop fasteners to secure the glove 100 securely to the hand of wearer 105. Of course, other fastener types may be utilized, such as snaps, buttons, and the like. Further, wrist cuff 100 may simply be sufficiently elastic to open to slide over the hand of wearer 105 but still retain a snug fit to retain glove 100 on the hand of wearer 105.

As illustrated in FIG. 1, palm portion 110 and associated plurality of pads 120 lacks any seam to retain pads 120 within palm portion 110. By limiting the use of seams to secure padding 120, a glove in accordance with the present invention reduces the risk of failure by stitching to secure pads during wear and tear incurred naturally during use of glove 100. Further, the lack of stitching to secure pads 120 enable the construction of glove 100 to be simplified and standardized to provide uniform and consistent results. As shown in the example of FIG. 1, pads 120 may be referred to as heel pads, in that they are positioned so as to protect the heel of the hand of the wearer 105 when the glove 100 is worn. If heel pads 120 are used, their number, arrangement, size, and orientation may vary from that shown in the example of FIG. 1.

Figure 2:
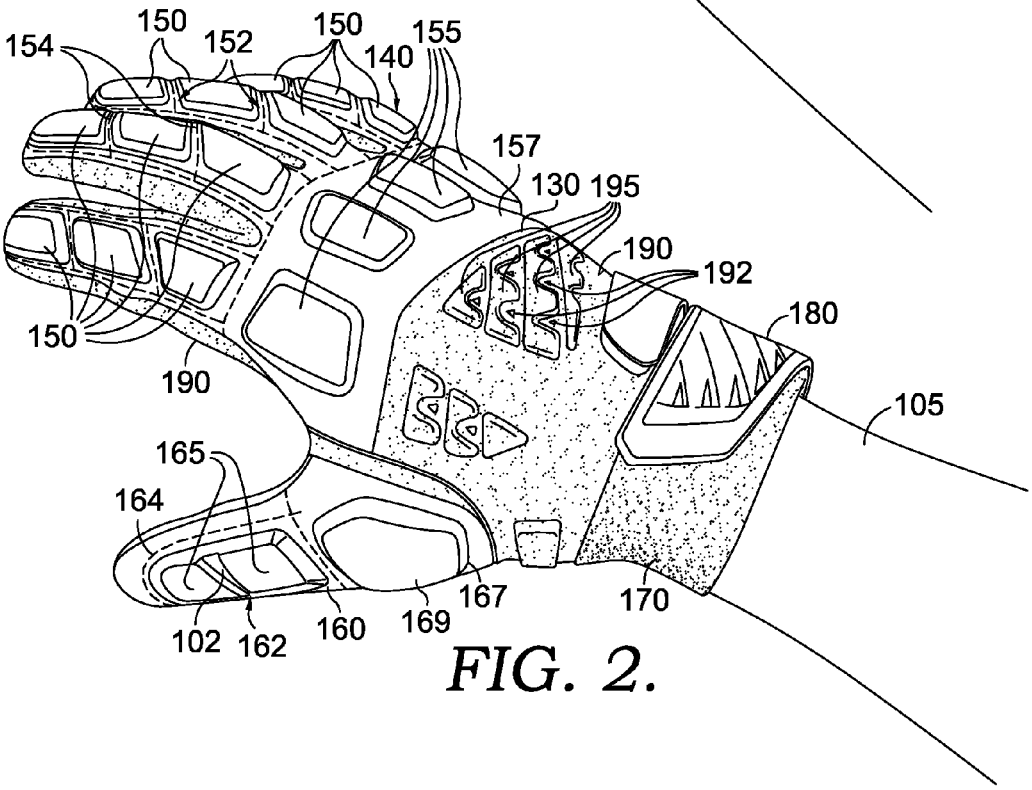
FIG. 2 illustrates a dorsal view of a glove in accordance with the present invention.

Referring now to FIG. 2, an illustration of a glove 100 in accordance with the present invention is illustrated from the dorsal surface of the hand of a user. FIG. 2 illustrates glove 100 with a pressed and stitched padded dorsal surface portion 140 comprising a plurality of laminated pads 150. In the example illustrated in FIG. 2, dorsal surface portion 140 extends up each of the four finger sheaths of glove 100. As shown in FIG. 2, padding 150 may comprise multiple pads 150 situated along each finger proximal and distal interphalangeal joints of the hand of a user when glove 100 is worn to permit the wearer to flex and/or articulate each finger. Multiple pads 150 may be formed by compressing a single piece of a compressible material, such as neoprene, to form individual pads separated by grooves 152. One or more stitch 154 may secure padded dorsal surface portion 140 to an interior layer of glove 100. One or more stitch 154 may be used in conjunction with an adhesive to secure padded dorsal surface portion 140, although either a stitch or an adhesive may be used individually. If used, stitch 154 may extend through some, all, or none of grooves 152 and/or the perimeter of pads 150. Further, stitch 154 may comprise one or multiple independent stitches. In the example of FIG. 2, padding comprises three pads 150 situated along each finger, which may be referred to as finger pad(s).

An additional laminated pad 155 may be situated near the metacarpophalangeal joint of each finger to protect the metacarpophalangeal joint of each finger, which may be referred to as knuckle pad or metacarpophalangeal joint pad. Metacarpophalangeal joint pads 155 may comprise a part of padded dorsal surface portion 140 or may comprise one or more additional portions of glove 100. Metacarpophalangeal joint pads 155 may be formed and/or secured to glove 100 similarly to finger pads 150. In the example illustrated in FIG. 2, metacarpophalangeal joint pads 155 may be contained within metacarpophalangeal joint portion 157. Metacarpophalangeal joint portion 157 may be situated underneath padded back portion 140 and/or other portions of glove 100. The exterior of metacarpophalangeal joint portion 157 may be any type of material, such as synthetic leather, nylon, etc. Optionally, each finger pad 150 and/or metacarpophalangeal joint pad 155 may have a size and/or shape suited to the portion of the finger and/or hand protected when glove 100 is worn. The size and/or shape, and even the location, of a pad such as pad 150 may vary based upon the size of the glove 100, the type of athlete for which glove 100 is intended, the position played by the athlete for which glove 100 is intended, etc. Some of the pads 150 and/or metacarpophalangeal joint pads 155 illustrated in the example of FIG. 2 may be omitted, while additional pads may be added, without departing from the scope of the present invention.

FIG. 2 further illustrates a padded thumb portion 160. In the example shown in FIG. 2, padded thumb portion 160 may comprise two laminated thumb pads 165 along the thumb of a wearer of glove 100. Padded thumb portion 160 may be fabricated using materials and/or techniques similar to those described above for dorsal surface portion 140. For example, a groove 102 may be pressed into a neoprene pod and a stitch 164 may be used to secure thumb portion 160 to glove 100. An additional metacarpophalangeal joint pad 169 may be located near base of the thumb. Thumb portion 160, which may be fabricated using materials and/or techniques similar to those described for metacarpophalangeal joint portion 157. The plurality of pads 165 permits enhanced flexibility and articulation of the thumb of an athlete while wearing glove 100. The number, size, shape, and/or location of pads 165 may vary to suit the likely needs of the intended wearer.

Non-laminated portion 190 may comprise any type of material, and may be crafted of an elastic material to facilitate flexibility and secure fit of glove 100 when worn by wearer 190. A plurality of holes 192 may provide ventilation for glove 100. Portion 190 may comprise additional padding 195 that may be secured, for example, using an adhesive or by stitching padding to an inner layer of portion 190. Padding 195 may be formed from compressed neoprene or any other padding material. Portion 190 may be secured to other portions of glove 100 using stitched seams 130, although adhesives or other fastening types may be used. Seams 130 may be located well away from pads, thereby reducing unnecessary wear and damage to seams 130. In the view illustrated in FIG. 2, seam 130 has been positioned near the center of the back of the hand of wearer 105, rather than near the knuckles of wearer 105, thereby decreasing stress on seam 130 when glove 100 is flexed, but still protecting the knuckles and fingers with pads 150.

Figure 3:
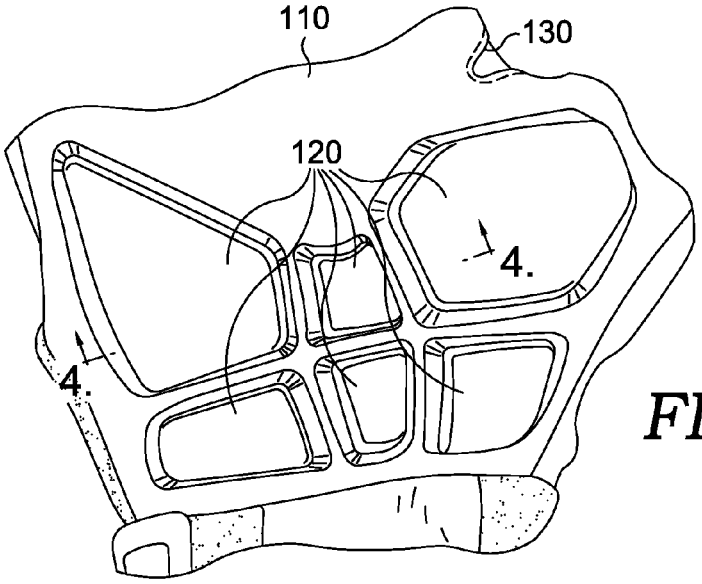
FIG. 3 illustrates a laminated portion of a glove in accordance with the present invention.

Referring now to FIG. 3, a view of palm portion 110 and plurality of pads 120 are illustrated. Plurality of pads 120 may comprise any number, size, shape, and configuration of padding. As described above, considerations such as hand size, sport, and position of the intended wearer of a glove in accordance with the present invention may render various numbers of pads to be used in varying sizes, shapes, properties, and/or arrangements. The exterior of palm portion 110 may comprise any type of material. A durable, pliable, material with grippability, such as rubber or TPU, may be used as exterior of palm portion 110.

Figure 4:
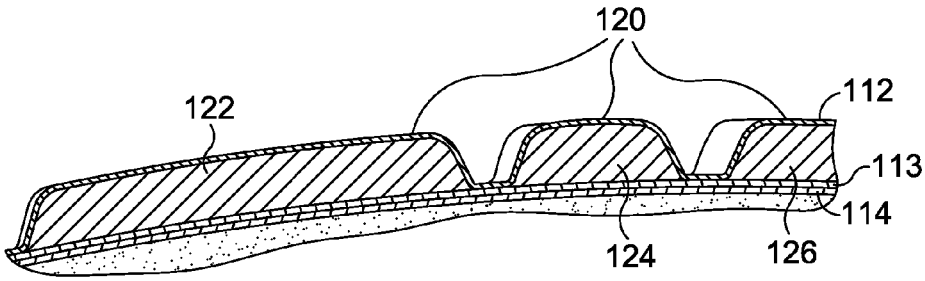
FIG. 4 illustrates a cross sectional view of a laminated portion of a glove in accordance with the present invention.

Line 4-4 in FIG. 3 indicates a cross section of palm portion 110 further illustrated in FIG. 4. As shown in FIG. 4, beneath exterior layer 112 pads 120 may comprise a first padding material portion 122, a second padding material portion 124, and a third padding material portion 126 to provide cushioning and protection for the hand of the wearer of glove 100. First padding material portion 122, second padding material portion 124, and third padding material portion 126 may comprise the same or different types of material. Materials suitable for use as padding material in conjunction with gloves in accordance with the present invention comprise, for example, various types of foam, silicone, rubber, compressible fibers, and the like. Padding material may, for example, be cut and/or compression molded to the size and/or shape desired for a particular pad location.

Exterior layer 112 may be molded to form depressions to receive pads 122, 124, and 126. Pads 122, 124, 126 may be situated between an outer layer 112 and an inner layer 114. Outer layer 112 may comprise the external material of glove 100 and may be formed of rubber or TPU. However, additional materials may be applied to outer layer 112 to provide a desired feel, water resistance, grip, durability, or other performance characteristic. Inner layer 114 may contact the skin of the hand of wearer, but need not. If inner layer 114 contacts the skin of a wearer, a material such as lycra may be used. However, various liners or other materials may be interposed in inner layer 114 and the hand of a wearer when the glove is worn to provide desired comfort, feel, texture, moisture management, or other performance characteristics. Adhesive layer 113 may secure pads 122, 124, 126 and outer layer 112 to inner layer 114. Any type of adhesive may be used for adhesive layer 113. Adhesive layer 113 may be a thermoplastic polymer that forms bonds with outer layer 112, inner layer 114, and/or pads 122, 124, 126 through the application of sufficient heat and pressure, thereby joining outer layer 112, inner layer 114, and pads 122, 124, 126. Alternatively, adhesive layer 113 may be a material that forms bonds through radio frequency or ultrasonic bonding processes, for example. With Regard to the use of a thermoplastic polymer as adhesive layer 113, the amount of heat and pressure applied to form bonds depends upon the specific material used, which may be, for example, polyurethane, polyamide, polyester, polyolefin, or vinyl. Suitable thermoplastic polymers formed from these materials may be supplied by Bemis Associates, Inc. of Shirley, Mass., United States. In general, heat and pressure induces adhesive layer 113 to soften or melt so as to infiltrate the structure of outer layer 112, inner layer 114, and/or pads 122, 124, 126. Upon subsequent cooling, adhesive layer 113 becomes securely bonded to outer layer 112, inner layer 114, and/or pads 122, 124, 126 to form an integrated laminated padded portion, such as palm portion 110.

Figure 5:
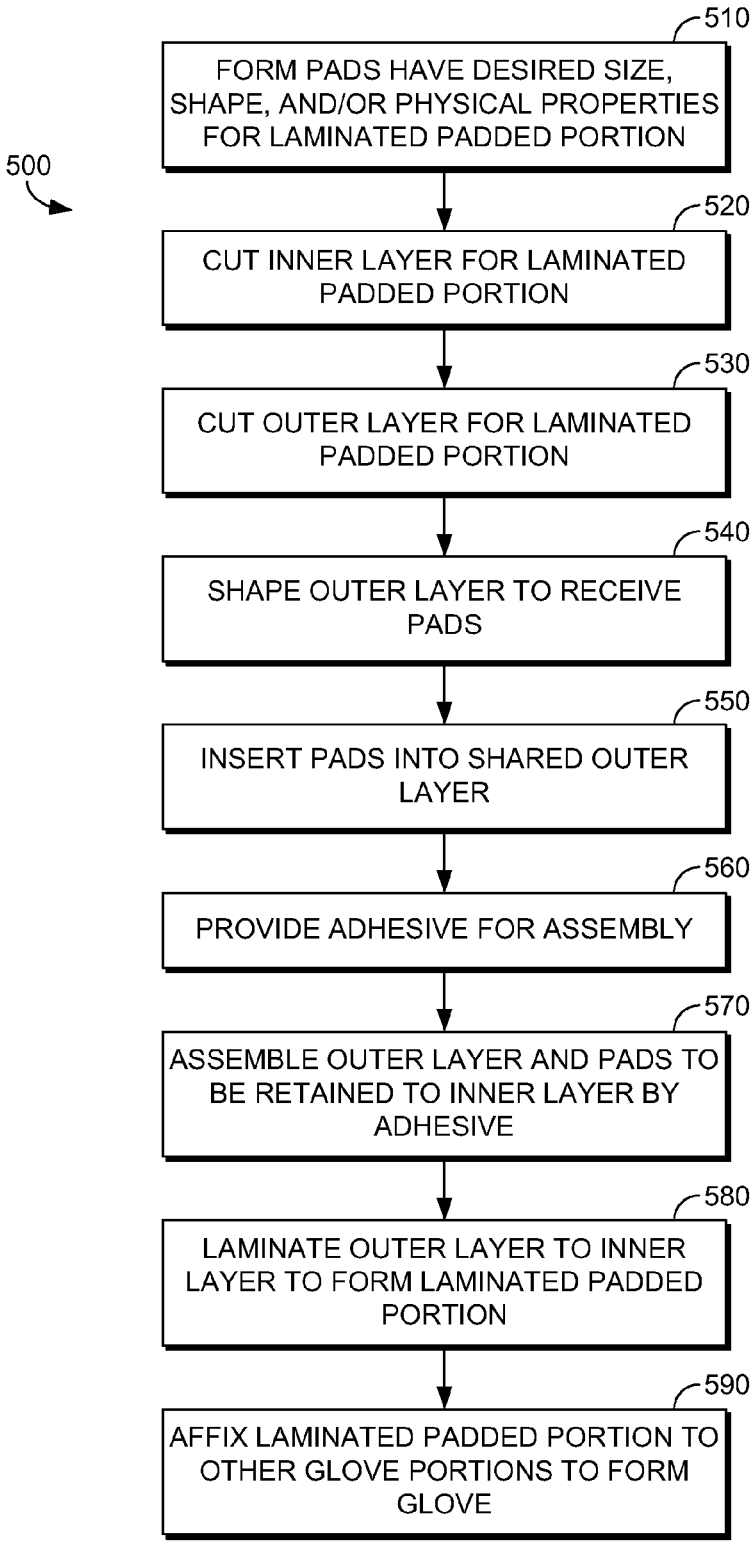
FIG. 5 illustrates a method of forming a glove in accordance with the present invention.

A laminated portion of glove in accordance with the present invention may be constructed in methods such as method 500 illustrated in FIG. 5. In step 510, pads may be formed having the desired size, shape, and/or physical properties for a laminated padded portion of a glove. For example, individual pads may be cut or molded to a desired size and shape from a material possessing the desired compressibility. For example, step 510 may cut pads having a variety of sizes and shapes from a foam material. In step 520, the inner layer for the laminated padded portion may be cut. Inner layer may be cut from lycra, nylon, polyester, cotton, or any type of fabric. In step 530, the outer layer for the laminated padded portion may be cut. Outer layer may be cut from any type of fabric. Coatings may be applied to the outer layer to provide desired properties, or outer layer may be cut from a material possessing desired properties itself, for example, rubber, TPU, and/or synthetic leather may be durable, flexible, and grippable. Step 520 and step 530 may use die cutting or other techniques to cut the desired amount and shape of fabric, leather, or other type of material from a sheet. Steps 510, 520, and 530 may be performed in any order, including simultaneously.

In step 540, the outer layer cut in step 530 may be shaped to receive the pads formed in step 510. Step 540 may comprise, for example, molding an outer layer formed of a rubber or a TPU material to form depressions into which pads may be inserted. The size and shape of such a depression formed in step 540 may correspond to the size and shape of pads formed in step 510. Further, step 540 may form depressions of multiple sizes and shapes to receive pads of multiple sizes and shapes. In step 550 the pads formed in step 510 may be inserted into the outer layer shaped in step 540. For example, in step 550 pads may be inserted into depressions having a shape and size corresponding to the inserted pad.

In step 560 an adhesive may be provided for use in assembling the laminated portion. Any type or types of adhesive may be provided in step 560. For example, a heat activated flexible tape adhesive such as is available from Bemis® Corporation may be cut to an appropriate size and shape. In step 570 the pads formed in step 510 and the outer layer cut in step 530 may be assembled to be retained to the inner layer cut in step 520. Step 570 may use double sided tape or any type of adhesive. In step 580, the outer layer may be laminated to the inner layer, thereby retaining the pads between the inner layer and the outer layer to form a laminated padded portion. Laminating in step 580 may comprise, for example, applying any heat and/or pressure needed to activate the adhesive provided in step 560 and assembled in step 570. For example, a glove portion with a portion of heat activated flexible tape used as an adhesive may be heated to approximately 200° F. to activate the beamis. In step 590, the laminated padded portion may be affixed to one or more other glove portions, some or all of which may be laminated padded portions, to form a glove. Step 590 may use stitching, adhesives, or any other technique.

Gloves in accordance with the present invention may provide laminated padded portions in locations other than the palm. Further, multiple laminated padded portions may be provided in a single glove in accordance with the present invention. A glove in accordance with the present invention may combine one or more laminated padded portion with any number of additional portions of any type. For example, a glove in accordance with the present invention may combine multiple laminated padded portions with any combination of non-laminated padded portions, non-padded portions, ventilated portions, stretchable portions, etc. Further any type of material may be used to fabricate the outer layer, inner layer, and pads of laminated portions of a glove in accordance of the present invention.

Embodiments of the present invention have been described with the intent to be illustrative rather than restrictive. Alternative embodiments may be practiced that do not depart from the scope of the present invention. Certain features and subcombinations are of utility and may be employed without reference to other features and subcombinations and are contemplated within the scope of the claims. Not all steps listed in the various figures need be practiced in methods in accordance with the present invention, nor need all steps be carried out in the specific order described.

Having thus described the invention, what is claimed is:

1. A glove comprising:

a first laminated padded portion that is adapted to cover at least a portion of a palm, a first portion of an index finger, a first portion of a middle finger, a first portion of a ring finger, a first portion of a pinky finger and a first portion of a thumb of a hand of a user when the glove is worn, the first laminated padded portion comprising:

(1) an inner layer adapted to contact the hand of the user when the glove is worn;

(2) an outer layer that comprises an exterior of the glove, the outer layer laminated to the inner layer; and (3) a first plurality of pads between the inner layer and the outer layer, the plurality of pads secured between the outer layer and the inner layer by laminating the outer layer to the inner layer without stitching; and a second portion adapted to cover at least a portion of a dorsal surface of the hand of the user, a second portion of the index finger, a second portion of the middle finger, a second portion of the ring finger, a second portion of the pinky finger and a second portion of the thumb of the hand of the user when the glove is worn, the second portion comprising at least one non-laminated padded portion and a second laminated padded portion, the second portion affixed to the first laminated padded portion to form a cavity comprising a thumb sheath, an index finger sheath, a middle finger sheath, a ring finger sheath, and a pinky finger sheath, such that the glove may be detachably retained on the hand of the user, the second laminated padded portion comprising:

(1) at least three separate metacarpophalangeal joint pads, wherein a first and a second metacarpophalangeal joint pads of the at least three metacarpophalangeal joint pads are separated by a first space between a region extending from the ring finger sheath and a region extending from the middle finger sheath, and the second and a third metacarpophalangeal joint pads of the at least three metacarpophalangeal joint pads are separated by a second space between a region extending from the middle finger sheath and the index finger sheath;

(2) four sets of finger pads located at each of the index finger sheath, middle finger sheath, ring finger sheath and pinky finger sheath, wherein each set of finger pads comprises three separate pads, further wherein the three separate pads of the each set of finger pads are separated by a first joint space adapted to correspond with a proximal interphalangeal joint of each finger of the hand of the user when the glove is worn, and a second joint space adapted to correspond with a distal interphalangeal joint of each finger of the hand of the user when the glove is worn.

2. The glove of claim 1, wherein at least two pads in the first plurality of pads cover a heel portion of the palm of the user when the glove is in the as-worn position.

3. The glove of claim 1, wherein the first plurality of pads comprise a foam material.

4. The glove of claim 3, wherein the outer layer comprises a rubber.

5. The glove of claim 3, wherein the outer layer comprises ThermoPlastic Urethane ("TPU").

6. The glove of claim 3, wherein the outer layer and the inner layer are laminated without stitching using a flexible tape adhesive.

7. The glove of claim 6, wherein the flexible tape adhesive is heat activated.

8. The glove of claim 3, further comprising at least one stitch that affixes the second laminated padded portion to the at least one non-laminated padded portion.

9. A glove comprising:

an index finger sheath, a middle finger sheath, a ring finger sheath, a pinky finger sheath and a thumb sheath formed by affixing together a palm-side portion and a dorsal-side portion of the glove;

a non-laminated padded region on a dorsal-side of the glove, wherein the non-laminated padded region comprises a plurality of ventilation holes; and a first and second laminated padded regions, wherein the first and second laminated padded regions comprise, one or more pad structures positioned to protect at least a portion of a hand of a user when the glove is in an as-worn position, the one or more pad structures being located between an outer layer and an inner layer of the glove;

the one or more pad structures comprising a first plurality of pads on the palm-side portion of the glove configured to protect a heel of the hand of the user when the glove is worn, and a second plurality of pads on the dorsal-side portion of the glove, the second plurality of pads comprising four separate metacarpophalangeal joint pads, wherein a first and a second metacarpophalangeal joint pads of the four metacarpophalangeal joint pads are separated by a first space between a region extending from a ring finger sheath and a region extending from the middle finger sheath, the second and a third metacarpophalangeal joint pads of the four metacarpophalangeal joint pads are separated by a second space between a region extending from the middle finger sheath and a region extending from the index finger sheath, and the third and a fourth metacarpophalangeal joint pads of the four metacarpophalangeal joint pads extending from the ring finger sheath and a region extending from the pinky finger sheath, one thumb metacarpophalangeal pad positioned to protect a thumb metacarpophalangeal joint, and four sets of pads on each finger sheath, wherein each set of the four sets of pads comprises three individual pads separated by a first groove configured to align with a distal interphalangeal joint and a second groove configured to align with a proximal interphalangeal joint of the hand of the user when the glove is worn; and an adhesive layer bonding the inner layer and the outer layer.

10. The glove of claim 9, wherein the adhesive layer comprises a thermoplastic polymer that bonds the inner layer and the outer layer through the application of heat and pressure.

11. The glove of claim 10, wherein the outer layer comprises a rubber.

12. The glove of claim 10, wherein the outer layer comprises a ThermoPlastic Urethane ("TPU").

13. The glove of claim 10, wherein the inner layer further comprises a liner that contacts the hand of the user when the glove is in the as-worn position.

14. A glove, the glove comprising:

a palm-side portion corresponding to a palm side and a dorsal-side portion positioned to correspond to a dorsal side of a user's hand when in an as-worn position, the palm-side portion having a palm portion, first four finger portions and a first thumb portion, and the dorsal-side portion having a dorsal portion, second four finger portions and a second thumb portion, wherein the palm-side portion is affixed to the dorsal-side portion to form a pinky finger sheath, a ring finger sheath, a middle finger sheath, an index finger sheath and a thumb sheath configured to receive a user's hand;

a first laminated padded portion adapted to cover at least a fraction of the palm portion of the glove, the first laminated padded portion comprising:

(1) a first inner layer adapted to contact the user's hand when the glove is in the as-worn position;

(2) a first outer layer that comprises the exterior of the glove; and (3) a first plurality of pads between the first inner layer and the first outer layer, the first plurality of pads secured between the first outer layer and the first inner layer by laminating the first outer layer to the first inner layer without stitching; and the dorsal-side portion comprising a non-laminated padded portion and a second laminated padded portion, wherein the non-laminated portion comprises a plurality of ventilation holes aligned with at least one pad secured to an inner surface of the non-laminated padded portion, and wherein the second laminated padded portion comprises:

(4) a second inner layer adapted to contact the user's hand when the glove is the as-worn position;

(5) a second outer layer that comprises the exterior of the glove; and a second plurality of pads between the second inner layer and the second outer layer, the second plurality of pads secured between the second outer layer and the second inner layer by laminating the second outer layer to the second inner layer without stitching, and wherein the second plurality of pads comprises at least three separate metacarpophalangeal pads.

15. The glove of claim 14, wherein the first plurality of pads comprises at least two pads adapted to cover a heel portion of the palm of the user's hand when the glove is in the as-worn position.

16. The glove of claim 14, wherein each second finger portion comprises three separate pads, wherein the three separate pads of the each second finger portion, are separated by a first proximal interphalangeal joint space and a first distal interphalangeal joint space such that the three separate pads of the each second finger portion, do not cover areas on the fingers of the user corresponding to the proximal and distal finger joints of the user when the glove is in the as-worn position.

* * * * *